US005887715A

United States Patent [19]

Vasudeva

[11] Patent Number: 5,887,715

[45] Date of Patent: Mar. 30, 1999

[54] TOOL CASE WITH SNAP-IN MODULES

[75] Inventor: Kailash C. Vasudeva, Waterloo, Canada

[73] Assignee: Maxtech, Inc., Roseville, Mich.

[21] Appl. No.: 907,497

[22] Filed: Aug. 8, 1997

[51] Int. Cl.[6] ..... B65D 85/20

[52] U.S. Cl. ..... 206/373; 206/379; 220/521; 220/524; 220/578; 312/902

[58] Field of Search ..... 206/373, 372, 206/370, 379; 312/902; 220/521, 524, 528; D9/294, 295, 305

[56] References Cited

U.S. PATENT DOCUMENTS

| | | | |
|---|---|---|---|
| 4,595,102 | 6/1986 | Cianci et al. | 206/370 X |
| 4,741,441 | 5/1988 | Keffeler | 220/528 X |
| 5,098,235 | 3/1992 | Svetlik et al. | 206/379 X |
| 5,114,007 | 5/1992 | Chen | 206/373 |
| 5,178,282 | 1/1993 | Williams | 206/370 X |
| 5,197,623 | 3/1993 | Wang | 220/521 X |
| 5,244,265 | 9/1993 | Chiang | 312/902 X |
| 5,368,164 | 11/1994 | Bennett et al. | 206/373 |
| 5,526,929 | 6/1996 | Wei | 206/372 X |
| 5,570,784 | 11/1996 | Sidabras et al. | 206/379 |
| 5,676,254 | 10/1997 | Cheng et al. | 206/373 X |
| 5,758,769 | 6/1998 | Vasudava | 206/372 |

FOREIGN PATENT DOCUMENTS

| | | | |
|---|---|---|---|
| 0015313 | 8/1894 | United Kingdom | 220/521 |

*Primary Examiner*—Bryon P. Gehman
*Attorney, Agent, or Firm*—R. Craig Armstrong

[57] ABSTRACT

A tool case with a storage space which is accessed from the underside of the tool case. The storage space may be fitted with various pre-assembled snap-in storage modules to provide the user with the flexibility of storing a wide variety of items in a wide variety of ways, depending on the user's needs. For example, the compartment may be fitted with a snap-in module comprising a series of rotating storage containers according to the preferred embodiment of the invention. Alternatively, the snap-in modules can comprise a series of sliding drawers, or a single rotating storage container, or any other tool or component holder. In the invention, a rectangular opening is defined within the bottom surface of the box portion of the tool case. Interior walls project upwardly from the edge of the opening to preferably define a storage space which accommodates a snap-in module. The module is secured within the storage space by inserting two tabs projecting outwardly from the first side of the module into corresponding slits located within the adjacent interior wall. The module is then rotated into the recess so that a plastic arm projecting away from the second side of the module engages a lip protruding from the adjacent interior wall. The lip is engaged by a jaw molded to the distal end of the arm.

9 Claims, 12 Drawing Sheets

TOOL CASE WITH SNAP-IN MODULES

BACKGROUND OF THE INVENTION

FIELD OF THE INVENTION

This invention relates to a tool case, particularly of the type used to display a tool set at the point of sale, and to subsequently store the tool set. Such tool cases are commonly referred to as "gift cases".

Cases of the general type are well known, and typically include a base in the form of an open-topped box, and a lid hinged or otherwise mated with the box portion, with a clip or other means to secure the lid in the closed position. The case typically also contains a panel with a number of recesses to accommodate various tools and components, such as a screwdriver and various bits therefor, for example.

However, this conventional configuration does not efficiently use the available space in the case because a large volume of unused space is left between the panel and the bottom of the box portion of the case.

SUMMARY OF THE INVENTION

In view of the above, it is an object of the invention to provide an improved tool case with a storage space which is accessed from the underside of the tool case. For greater flexibility, the storage space may be fitted with various pre-assembled snap-in storage modules to provide the user with the flexibility of storing a wide variety of items in a wide variety of ways, depending on the user's needs. For example, the compartment may be fitted with a snap-in module comprising a series of rotating storage containers according to the preferred embodiment of the invention. Alternatively, the snap-in modules can comprise a series of sliding drawers, or a single rotating storage container, or any other tool or component holder.

In the invention, a preferably rectangular opening is defined within the bottom surface of the box portion of the tool case. Interior walls project upwardly from the edge of the opening to preferably define a storage space which accommodates a snap-in module. The module is secured within the storage space by any suitable means, such as by inserting two tabs projecting outwardly from the first side of the module into corresponding slits located within the adjacent interior wall. The module is then rotated into the recess so that a plastic arm projecting away from the second side of the module engages a lip protruding from the adjacent interior wall. The lip is engaged by a jaw molded to the distal end of the arm.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
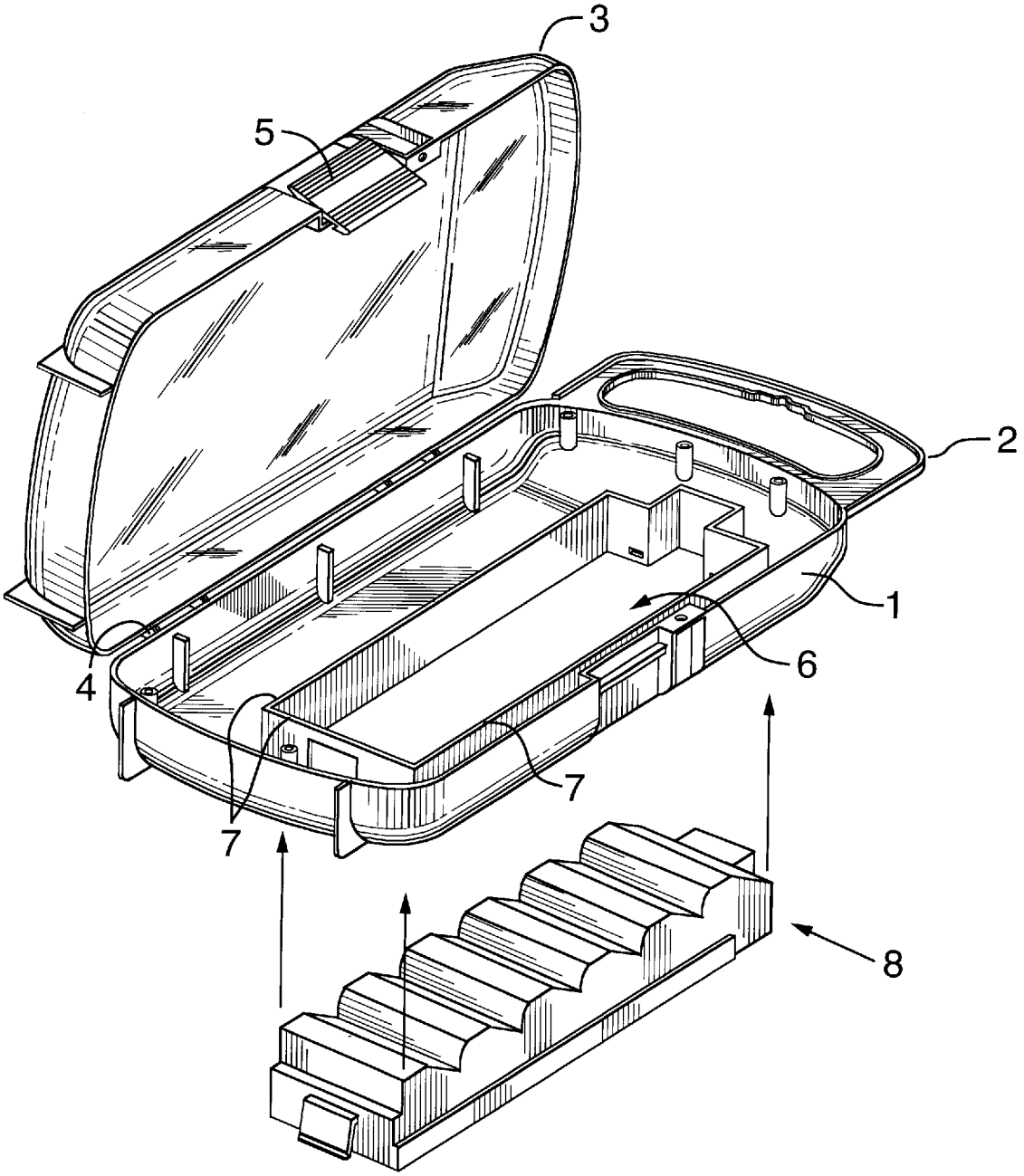
FIG. 1 is an exploded perspective view of the tool case showing the storage space and the snap-in module according to the preferred embodiment of the invention.

Referring to the drawings, FIG. 1 shows the tool case which includes a main box portion 1 with a handle 2 molded to the front edge thereof, as well as a preferably transparent lid 3 hinged to the box portion, for example, by two hinges 4, and secured to the box portion by a clip 5. Preferably, the tool case is made entirely from plastic.

A generally rectangular opening 6 defined within the bottom surface of the box portion. Molded interior walls 7 project upwardly from the edges of the rectangular opening into the box portion to define a storage space 15 which accommodates a snap-in module 8, such as the "drop bin assembly" shown in FIGS. 1–6.

Figure 2:
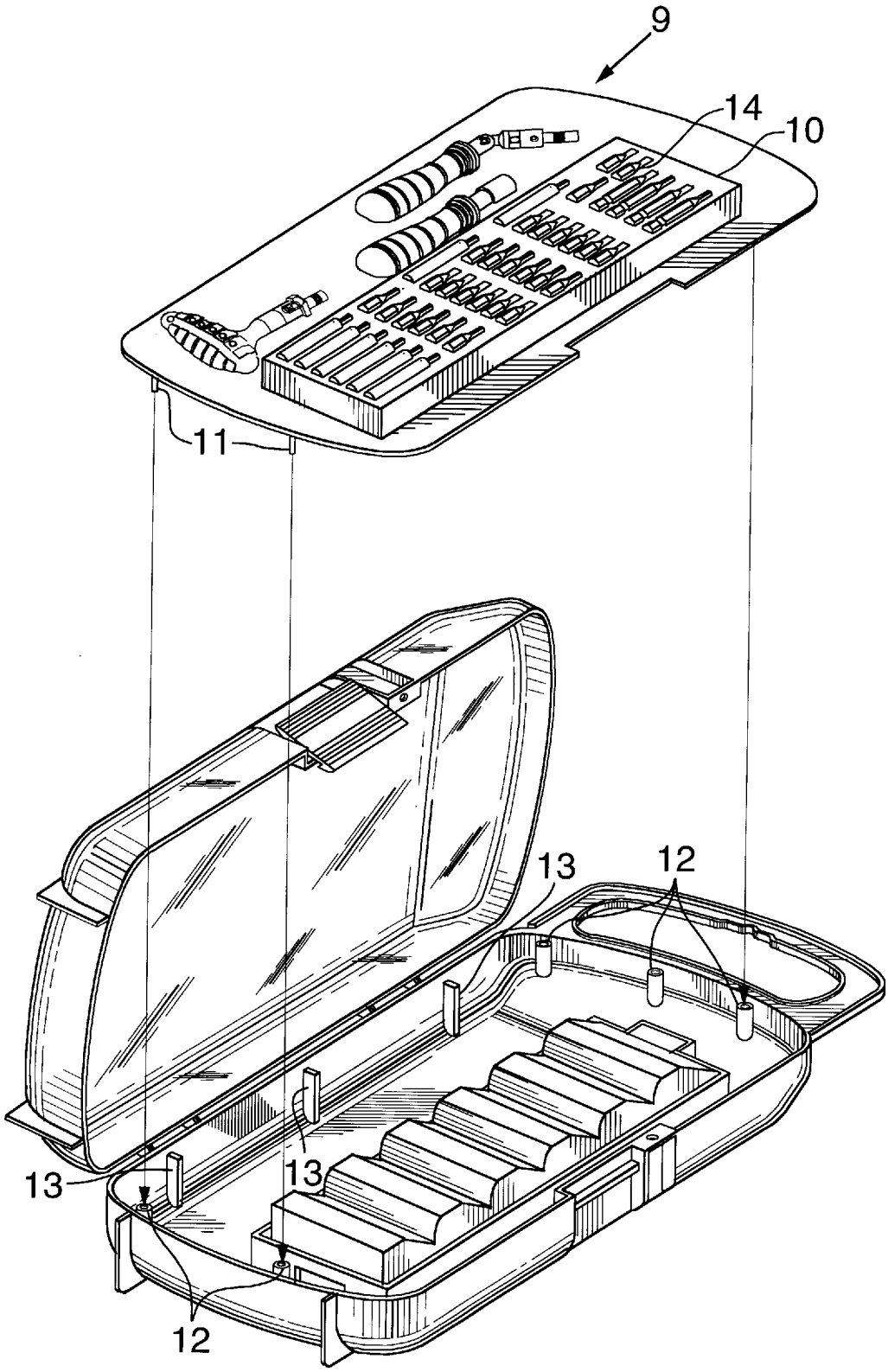
FIG. 2 is an exploded perspective view from the top of the tool case showing a tool and component holding panel.
Figure 3:
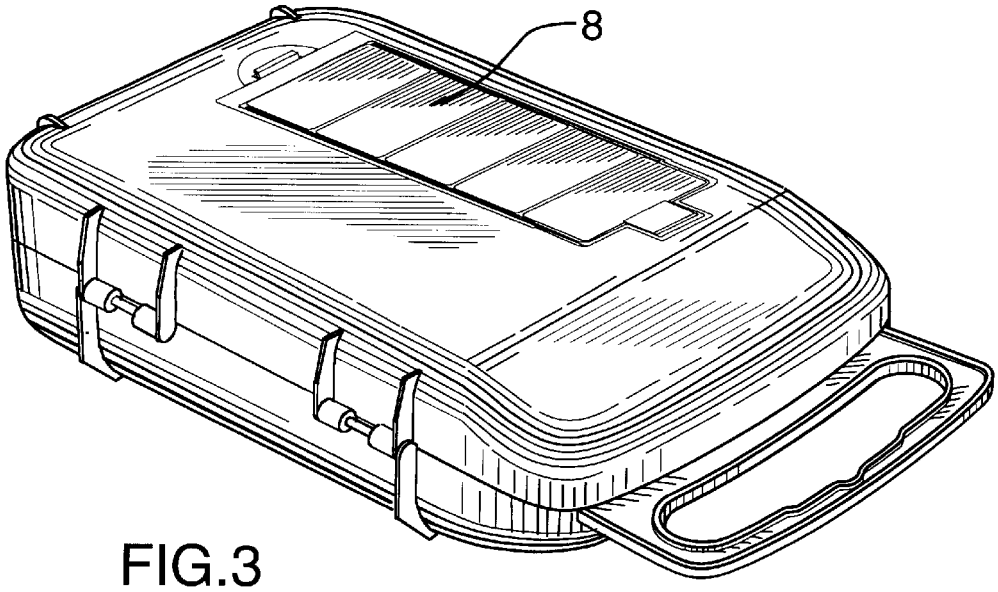
FIG. 3 is a perspective view from the underside of the tool case.
Figure 4:
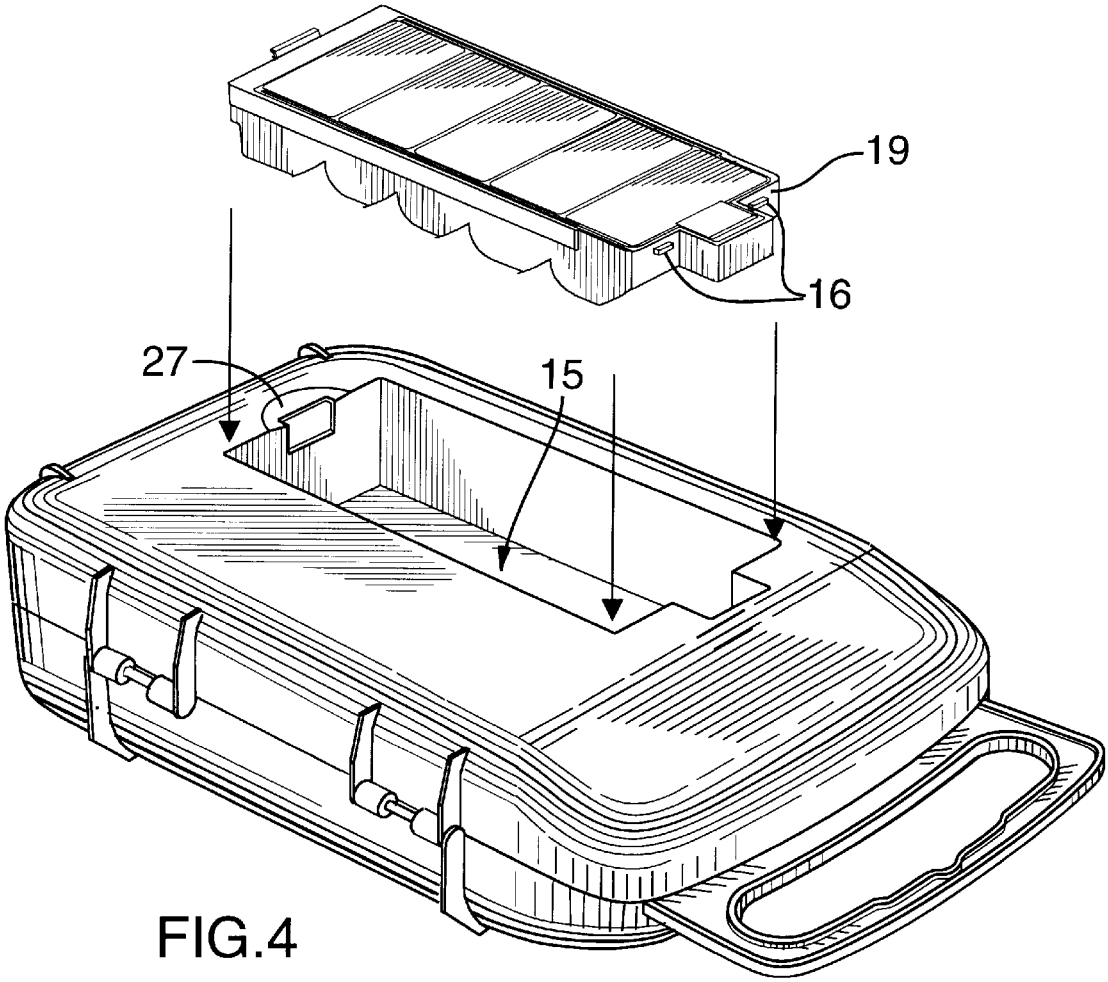
FIG. 4 is an exploded perspective view showing a "drop-bin module" installable in the storage space.

FIG. 2 shows a plastic panel 9, preferably molded with a raised portion 10 located over the rectangular opening to provide extra space for the snap-in module. However, a flat panel could be used in the tool case, although the space available for a snap-in module would, of course, be smaller. The panel is secured to the box portion by any suitable means, such as, for example, by inserting posts 11 protruding from the panel into corresponding sleeves 12 molded onto the box portion. For additional support, the panel rests on preferably three support members 13 along the side of the box portion adjacent to the hinges. Various shapes 14 are molded within the panel to accommodate corresponding tools with substantial depth, as well as components such as screwdriver bits and sockets. The shapes defined within the raised portion of the panel and components retained therein have little depth, and are, therefore, only adapted to retain components such as screwdriver bits and sockets. The shapes are molded in such a way that the corresponding tools and components can be secured by snapping same into the corresponding shapes 14 in a conventional manner, so that if the tool case is oriented with the lid facing downward, the tools stored in the first panel do not fall out of their designated shapes.

FIGS. 1–5 show the preferred embodiment of the invention where a "drop-in" module 8 is secured within the storage space 15 by snapping the module into the interior walls 7 by any suitable means. For example, two tabs 16 extending outwardly from a first side 19 of the of the module are inserted into corresponding slits 20 located within an adjacent interior wall. The module is then rotated into the storage space so that a flexible molded plastic arm 21 projecting upwardly and away from the second side 22 of the module engages a lip 23 protruding from the adjacent interior wall. The lip is engaged-by a jaw 24 located at the distal end of the arm which snaps onto said lip to secure the module to the box portion. A semi-circular depression 27 is defined within the box portion surrounding the lip.

Figure 5:
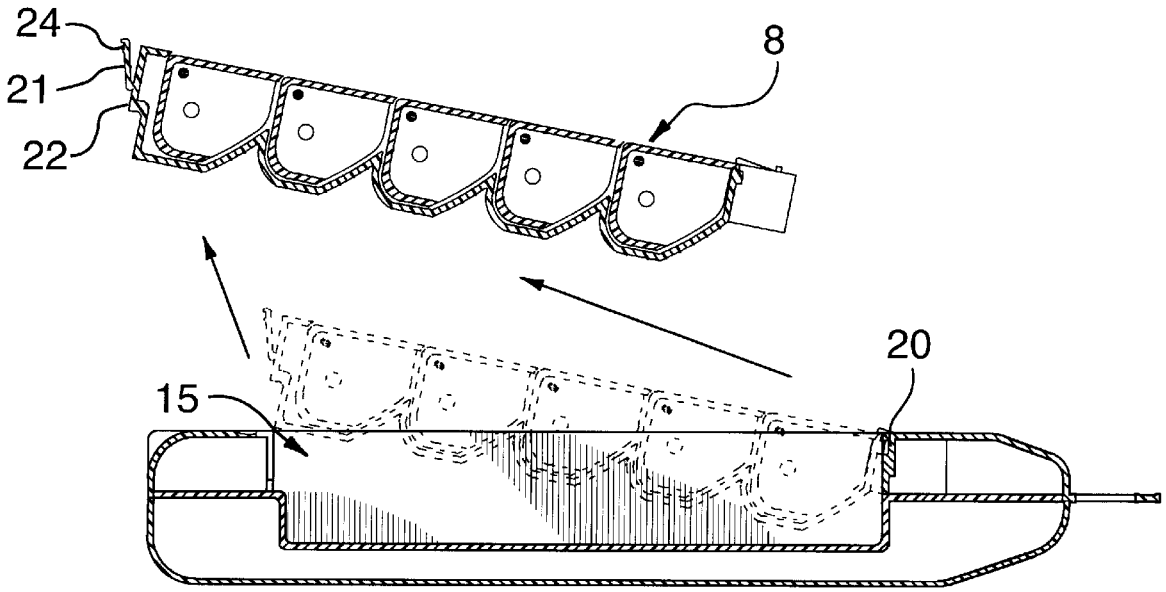
FIG. 5 is a cross-sectional view showing the removal of the drop-bin module.
Figure 5A:
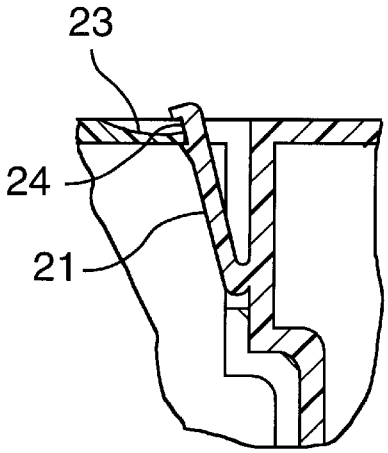
FIG. 5A is a cross-sectional view of the securing mechanism for the module.

As best shown in FIG. 5, the module is removed by the user sliding his/her finger into the semi-circular depression 27 which allows the finger to engage the arm 21 and pull it away from the box portion, freeing the module to be rotated out of the storage space 15.

Figure 6:
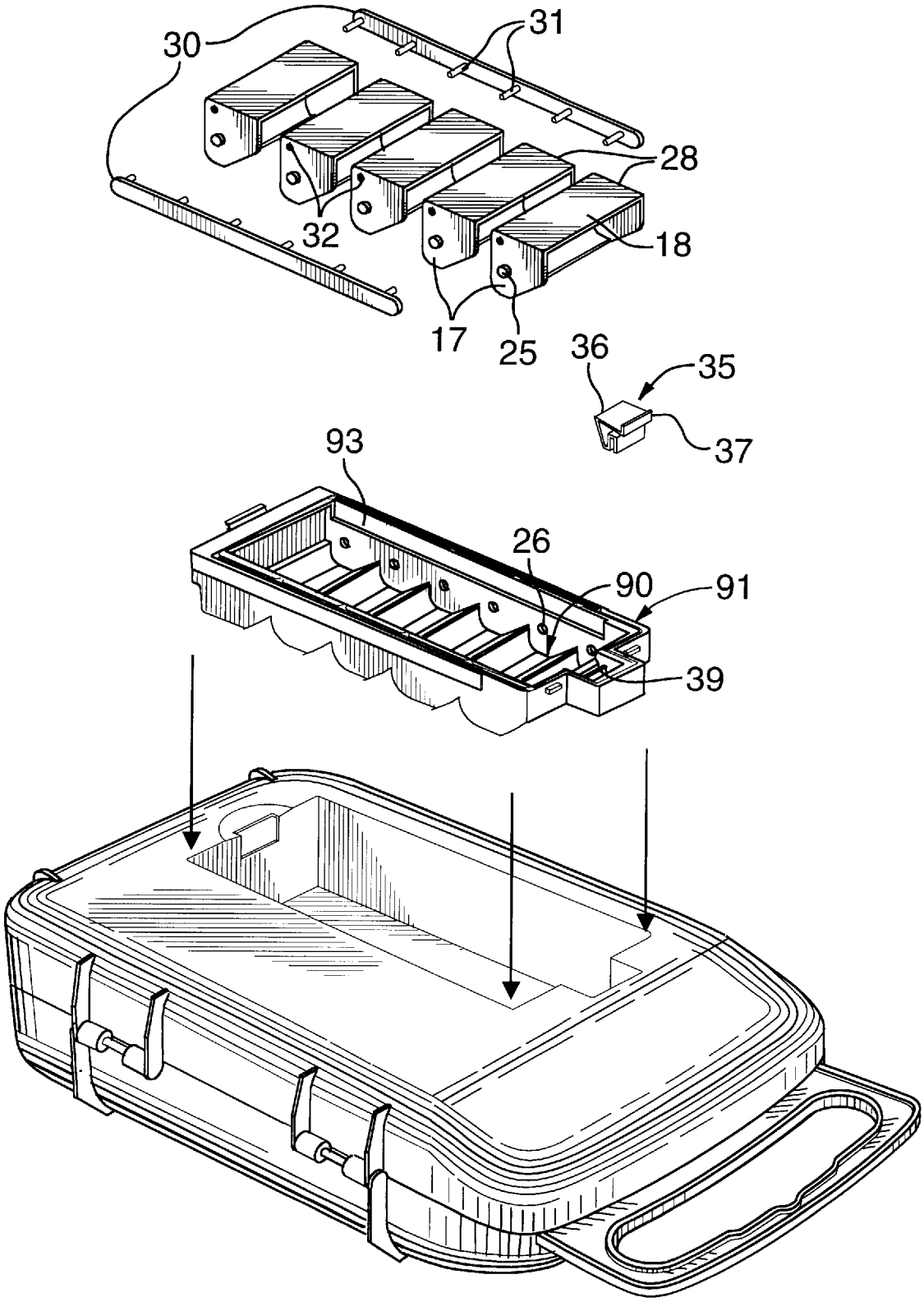
FIG. 6 is an exploded perspective view of the drop-bin module and case.

FIG. 6 shows the preferably five identical drop-bin storage containers 28, each having two identical parallel five-sided walls 17 which are joined by three generally rectangular faces 18 to form the container. The two remaining faces are open to provide access to the storage container. The storage containers are preferably molded from clear plastic to permit the user to examine the contents without opening the containers.

In the closed position, the faces of the storage containers preferably form a single plane flush with the bottom surface of the box portion so that the bottom of the tool case can rest flat on a work surface when the user has opened the lid 3 to access the tools in the panel 9.

The storage containers locate within a recess 90 defined within the body 91 of the module, and each container is joined to the sides of the recess by a male connection pin 25 which extends outwardly at a right angle from the two walls of each storage container. A corresponding recessed female connection means 26 adapted to receive the pins of each storage container is molded into both sides of the recess adjacent to the walls of the containers. The pin of each storage container is inserted into the corresponding female connection means, such that the containers are prevented from falling out of the recess, but are permitted to freely rotate. Alternative methods of pivotally connecting the storage containers to the box portion will be apparent to those skilled in the art and are within the scope of the invention.

The storage containers are joined, preferably, by two gang bars 30 to allow the containers to only move in unison. The two gang bars are located in two corresponding grooves 93 defined within the sides of the recess. The gang bars are connected to the storage containers by protruding cylindrical male connections 31 located along their length which fit snugly into female openings 32 in the side walls of each storage container. It should be clear to those skilled in the art that only one gang bar could be employed.

The storage containers are prevented from freely rotating by a plastic clasp configuration 35 molded from one piece of plastic, secured to the body 91 of the module, and preferably located adjacent to the storage container closest to the handle. A section of the clasp 38 molded into aperture is snapped by conventional means onto a co-operating plastic member 39 extending outwardly from the body. The clasp configuration also includes a ridge 36 extending over the face of the storage container which is flush with the bottom of the tool case to secure the container in the closed position, as well as a catch 37 to permit the user to easily grasp the clasp configuration. To pivot the containers to the open position, the user grasps the catch and pulls it away from the storage containers lifting the ridge which extends over the adjacent storage container and restricts its rotation. The user can freely pivot the storage container adjacent to the clasp into an open position, and when he/she does so, he/she also moves the gang bar connected thereto, which gang bar then imparts the motion to all the other containers causing them to move in unison. It should be noted, however, that other suitable means of securing the storage containers to the box portion may be used and such means would be within the scope of the invention.

It should be understood that the above description relates to the preferred embodiment by way of example only. Many variations on the invention will be obvious to those knowledgeable in the field, and such obvious variations are within the scope of the invention as described and claimed, whether or not expressly described.

Figure 7:
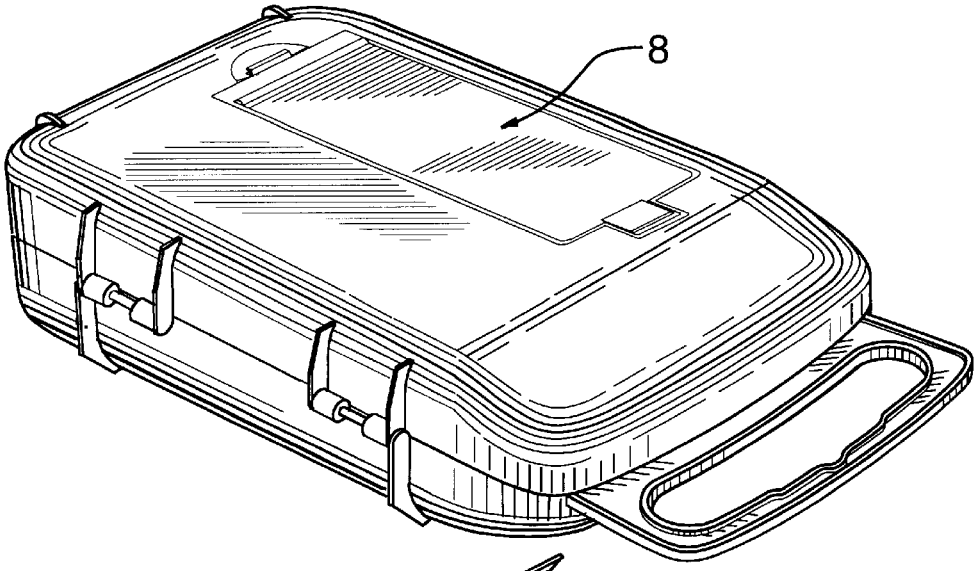
FIG. 7 is a perspective view of an alternative storage container module in the case.
Figure 8:
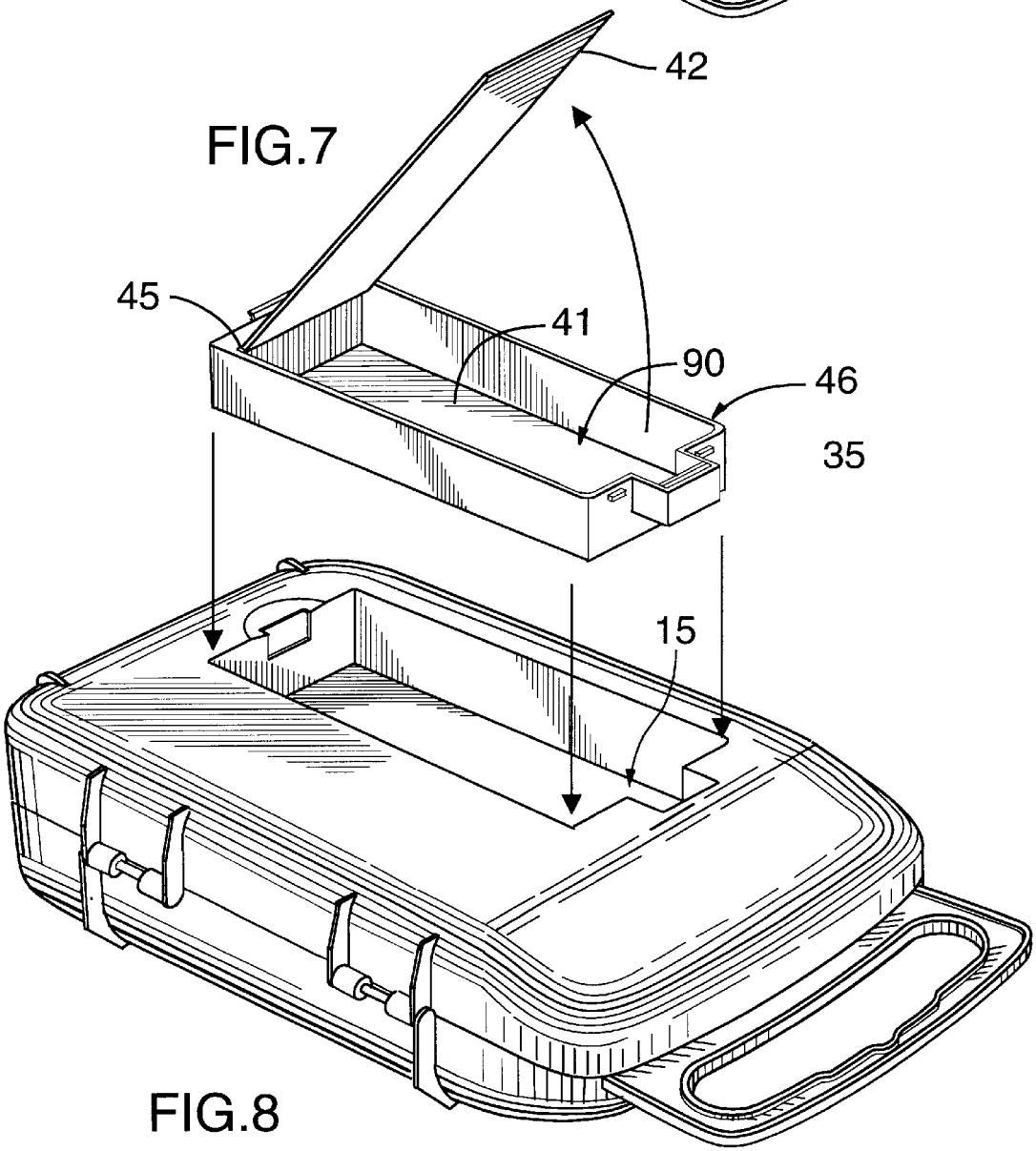
FIG. 8 is an exploded perspective view of the alternative storage container module and case.

For example, FIGS. 7 and 8 show an alternative embodiment of the invention where a recess 90 is defined within the body 46 of the snap-in module 8 to define a generally box-shaped storage container 41. A door 42 is rotatably connected to the body by any suitable means, such as, for example, a living hinge 45. The door is secured to the storage container by a plastic clasp configuration 35 snapped onto a plastic member 39, as described in the preferred embodiment, such that when the door is in the closed position it is flush with the bottom surface of the box portion. The module is snapped into the storage space 15 in the same manner as the preferred embodiment described above.

Figure 9:
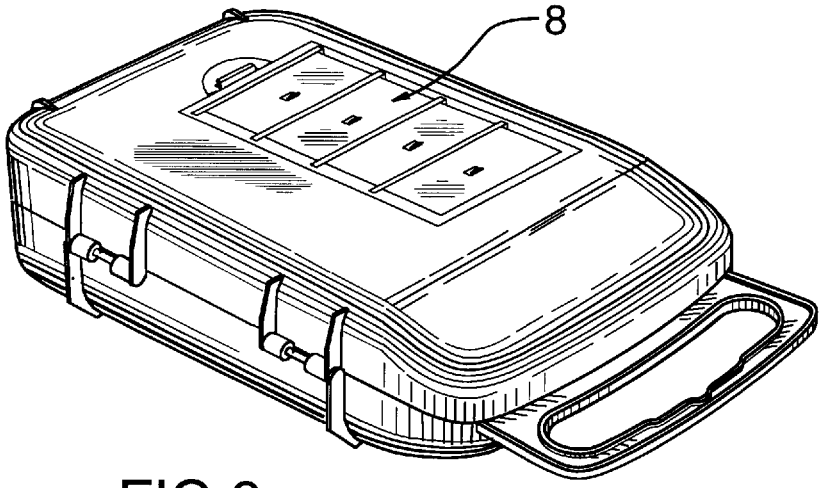
FIG. 9 is a perspective view of a sliding drawer module in the case.
Figure 10:
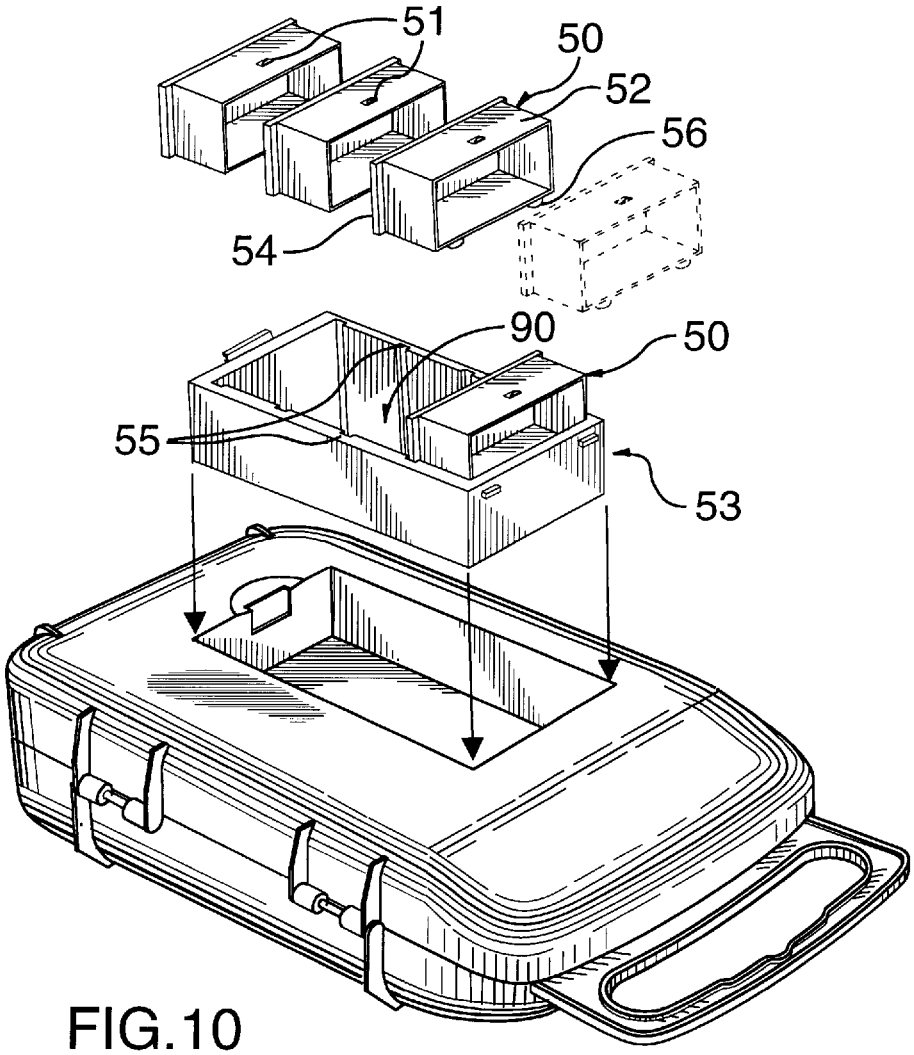
FIG. 10 is an exploded perspective view of the sliding drawer module in the case.

FIGS. 9 and 10 show an alternative embodiment of the invention where the snap-in module 8 comprises four box-shaped drawers 50 secured within a recess 90 defined within the body 53 of the module. A molded handle 51 defined within the outer face 52 of each drawer. It should be clear to those skilled in the art that the module can be configured with any number of drawers, and such variations are clearly within the scope of this invention. The drawers are slidably connected to the body by any suitable means. For example, molded rails 54 projecting outwardly from the bottom face of each drawer slide within corresponding channels 55 defined within the inner surface of the walls of the body. The drawers are prevented from falling out of the body of the module by drawer tabs 56 molded to the top of the inner face of each drawer. In the closed position, the outer face of each drawer is flush with the bottom surface of the box portion 1. Again, this module is secured within the storage space in the same manner as the preferred embodiment described above.

Figure 11:
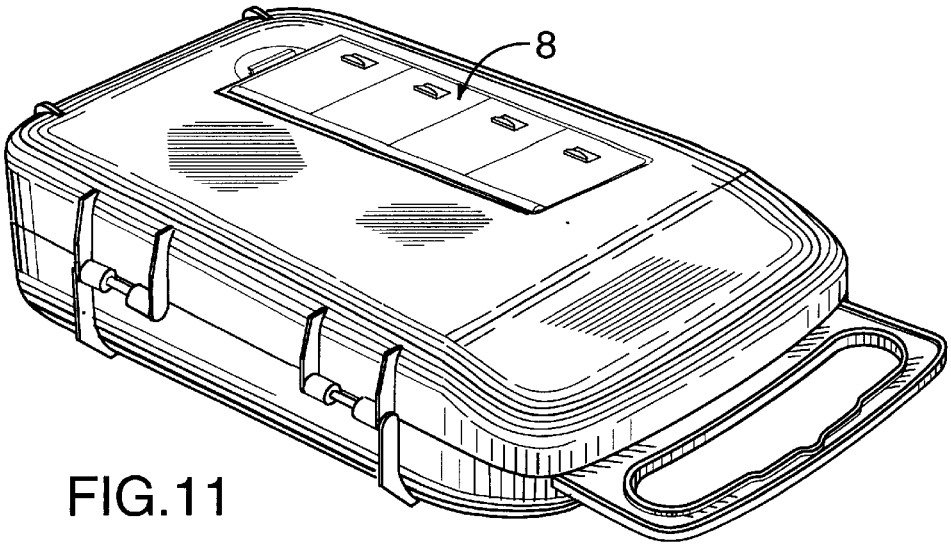
FIG. 11 is a perspective view of a wedge-shaped container module in the case.
Figure 12:
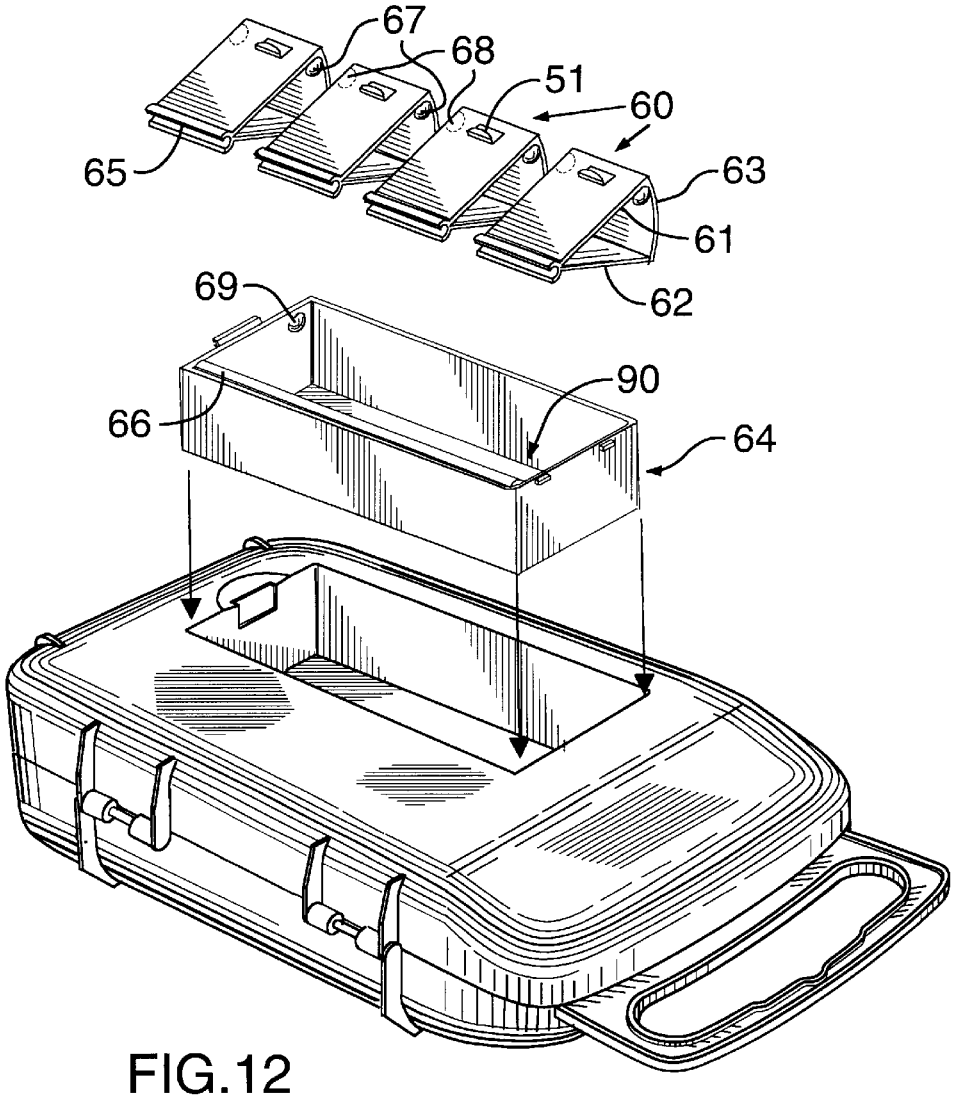
FIG. 12 is an exploded perspective view of the wedge-shaped container module and the case.
Figure 13:
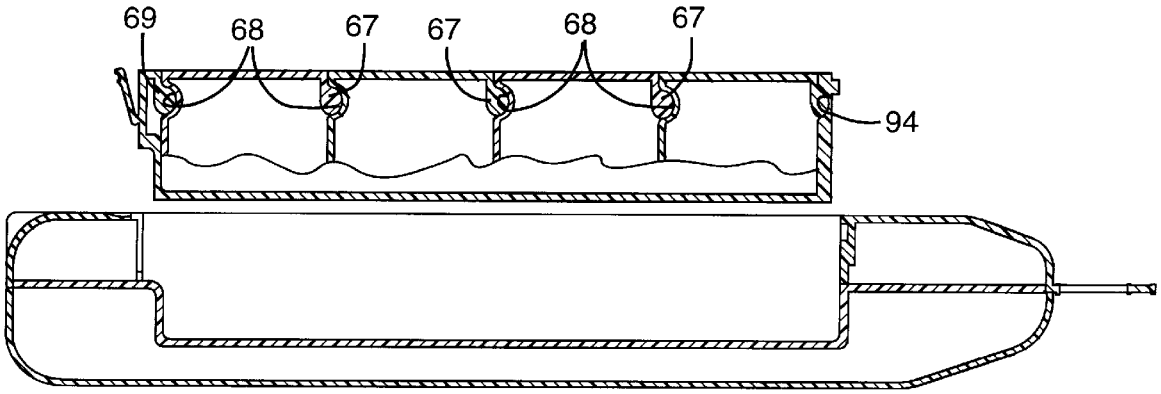
FIG. 13 is a cross-sectional view of the wedge-shaped container module.
Figure 13A:
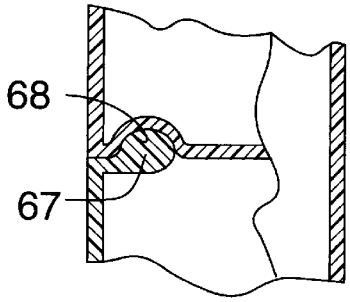
FIG. 13A is cross-sectional view of the securing mechanism for the wedge-shaped containers.

FIGS. 11 to 13 show an alternative embodiment of the invention four wedge-shaped storage containers 60 are secured within a recess 90 defined within the body 64 of the snap-in module 8, although any number of storage containers may be fitted within the module and such variations are within the scope of this invention. Each storage container is defined by a converging outer face 61 and inner face 62 joined by a rounded container wall 63. A handle 51 is defined within the outer face of each container. Each container is rotatably connected to the body by any suitable means. For example, a C-shaped channel 65 molded to the edge of the container where the outer and inner faces converge, is snapped onto to a molded cylindrical rail 66 running along the top of the inner face of the body. In the closed position, the outer face of each container is flush with the bottom surface of the box portion and is secured in place by a flexible molded button 67 protruding outwardly from the outer face of each container, and from an identical button 69 protruding from the side of the body adjacent to the rearmost container. The button snaps into a corresponding pocket 68 defined within the outer face of an adjacent container, and the button for the forwardmost container snaps into an identical pocket 94 defined within the adjacent side of the body of the module. Clearly, alternative methods of securing the containers in the closed position may be used and are within the scope of this invention. The module is secured within the storage space 15 in the same manner as the preferred embodiment described above.

Figure 14:
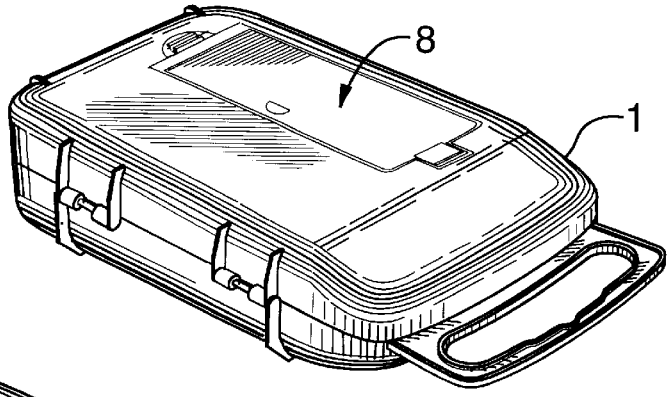
FIG. 14 is a perspective view of a multi-compartment container module in the case in the closed position.
Figure 15:
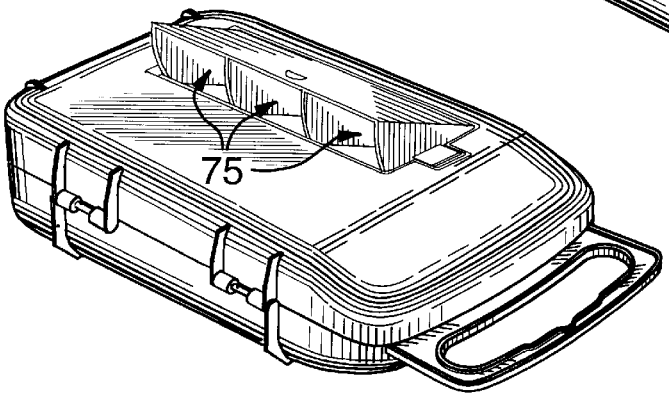
FIG. 15 is a perspective view of the multi-compartment container module in the case in the open position.
Figure 16:
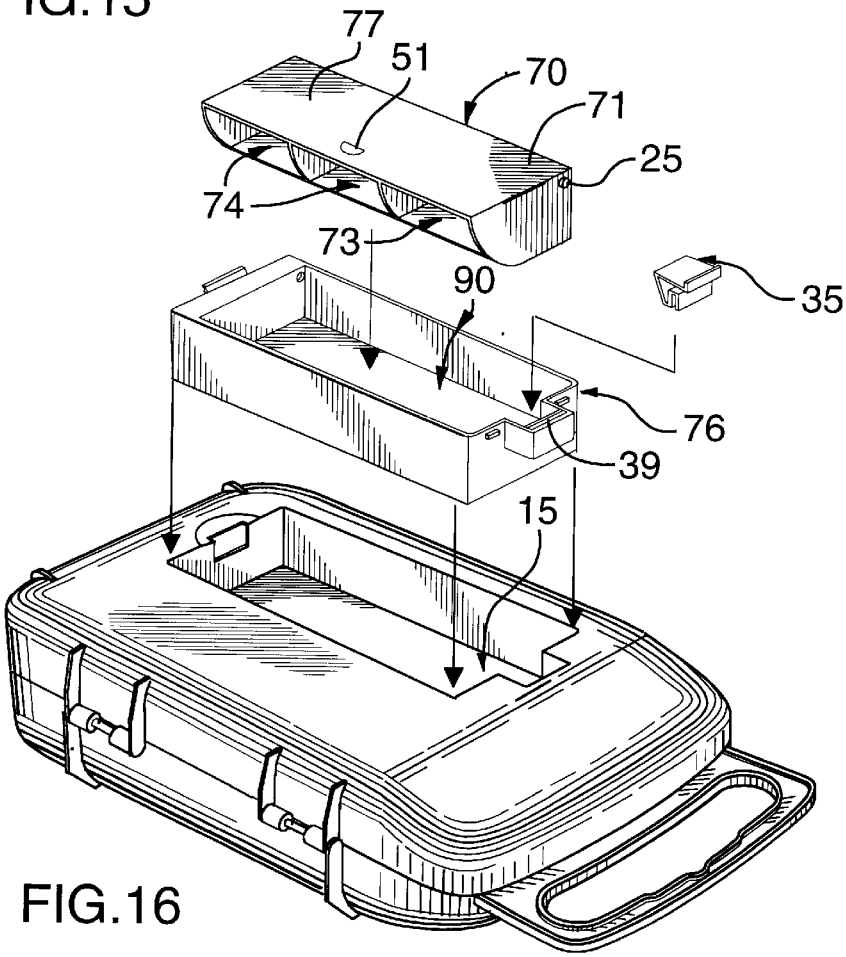
FIG. 16 is an exploded perspective view of the multi-compartment container module.

FIGS. 14–16 show an alternative embodiment of the invention where the snap-in module comprises a multi-compartment storage container 70 having two identical parallel outer walls 71 which are joined by three rectangular faces. The fourth face 73 is open to provide access to the container. Two integrally molded dividing walls 74 are located within the container to define three equal compartments 75. The container is rotatably mounted within a recess 90 defined within the body 76 of the module by any suitable means, such as male connection pins 25 projecting outwardly from the outer walls which mate with female connection means (not shown), as described in the preferred embodiment. A handle 51 is defined within the outer face 77. In the closed position, the outer face of the container is flush with the bottom surface of the box portion 1, and in the open position, the open face is rotated away from the box portion to allow the user access to the contents of the compartments. The container 70 is secured in the closed position by a plastic clasp configuration 35 snapped onto a plastic member 39, as described in the preferred embodiment. The module is secured within the storage space 15 in the same manner as the preferred embodiment described above.

Figure 17:
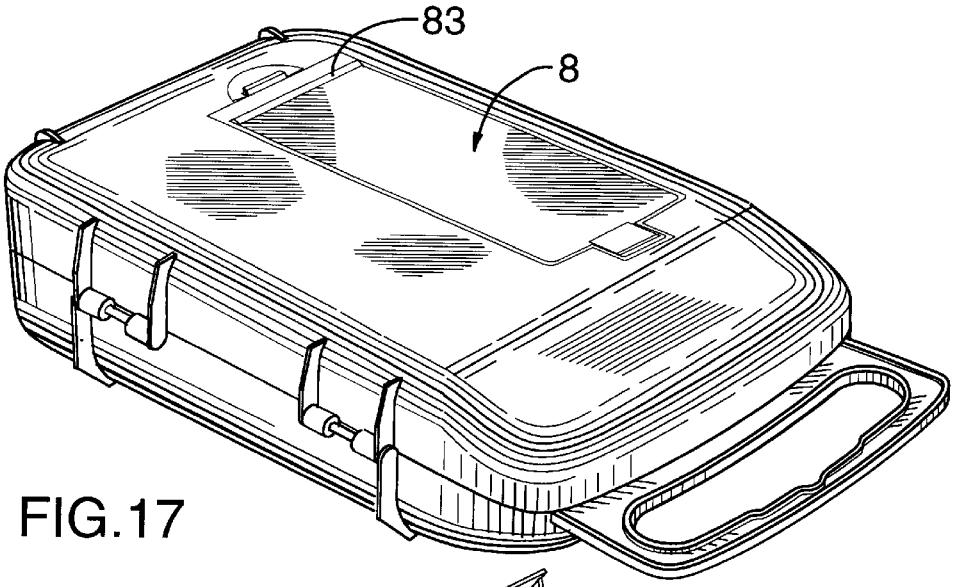
FIG. 17 is a perspective view of a multiple shelf module in the case.
Figure 18:
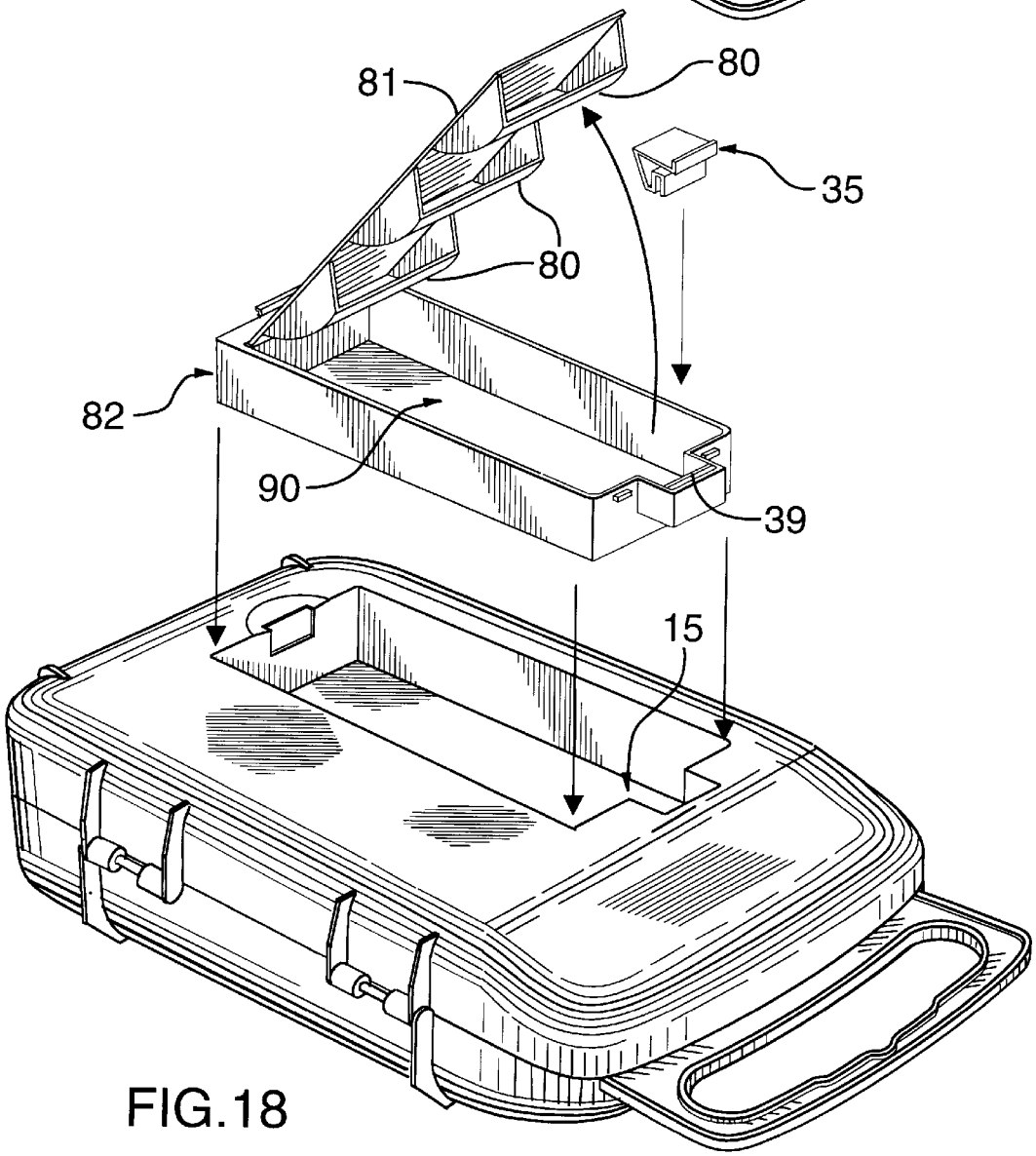
FIG. 18 is an exploded perspective view of the multiple shelf module and the case.

FIGS. 17 and 18 show an alternative embodiment of the invention where the snap-in module 8 comprises three storage shelves 80 molded to a door 81 which is rotatably connected to the body 82 of the module by a conventional hinge 83. It will be understood by those skilled in the art that any number of shelves may be molded to the door, and such variations are within the scope of this invention. A recess 90 within the body accommodates the shelves when the door is in the closed position. The door is secured to the storage container by a plastic clasp configuration 35 snapped onto a plastic member 39, as described in the preferred embodiment, such that when the door is in the closed position it is flush with the bottom surface of the box portion. The module is snapped into the storage space 15 in the same manner as the preferred embodiment described above.

It should be clear to those skilled in the art that the storage space and the snap-in module 8 securable within same can extend over the entire surface the bottom surface of the box portion, or alternatively, it could occupy only a section of the bottom surface of the box portion, and such variations are clearly within the scope of this invention.

Figure 19:
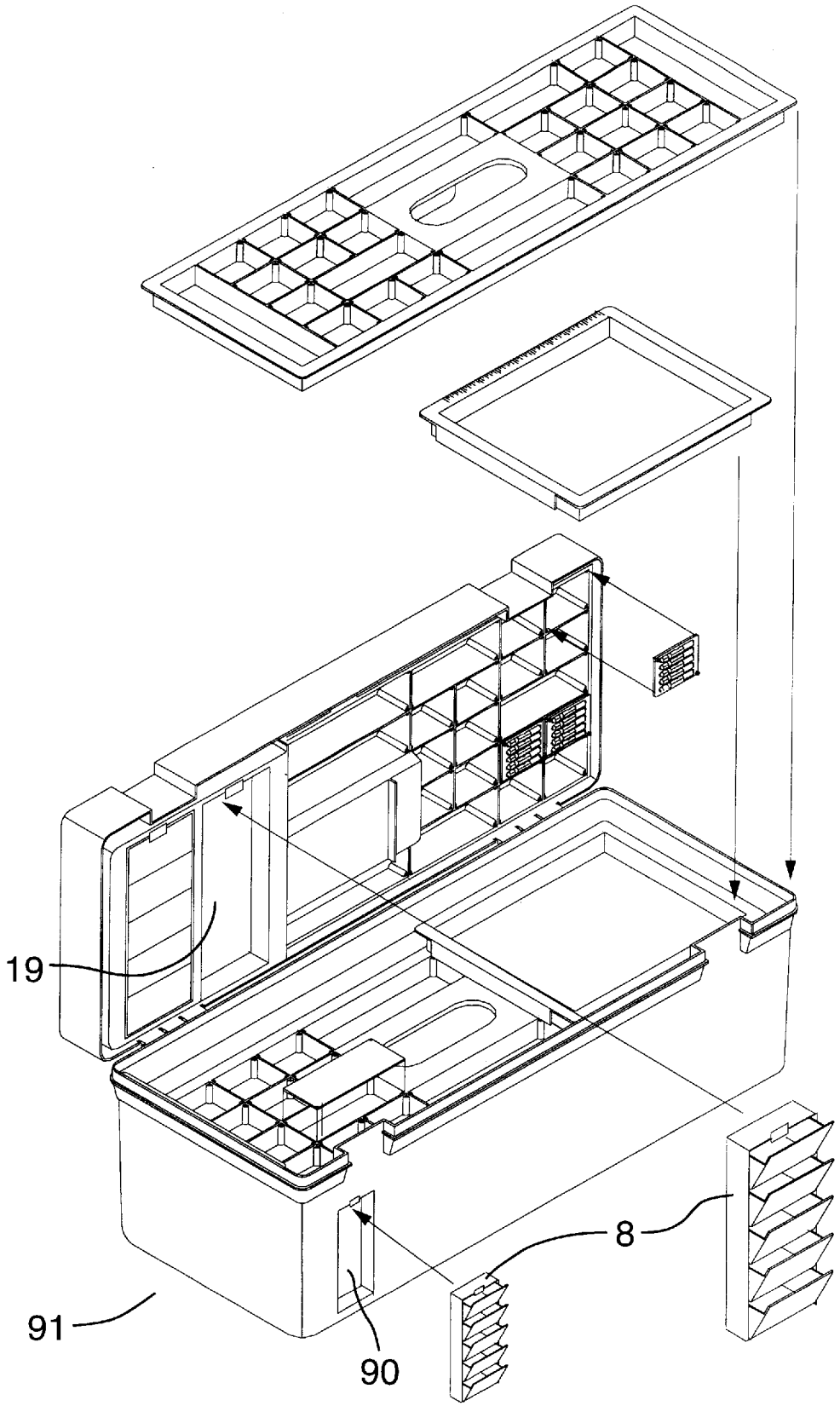
FIG. 19 is an exploded perspective view of an alternative embodiment of the invention showing the snap-in modules connected to a tool box.

FIG. 19 shows an alternative embodiment of the invention where the snap-in module 8, as described in the preferred embodiment, is snapped into a recess 90 defined within the side or a lid of a tool box 91. The module is snapped into the recess in the same manner as described in the preferred embodiment above. There may be multiple recesses, defined in inner and/or outer surfaces of the box portion and/or the lid.

What is claimed as the invention is:

1. A tool case comprising a box portion defining a main storage area, a lid pivotally connected to said box portion, a recess defined in at least one exterior surface of said tool case, and at least one removable module, each removable module being removably securable in said recess and configured to provide a secondary storage area, said at least one removable module having a plurality of separate storage compartments accessible when said at least one removable module is secured in said recess.

2. A tool case as recited in claim 1, wherein one of said compartments is pivotable relative to its module, between open and closed positions.

3. A tool case as recited in claim 2, such that in said closed position, an outer face of each of said compartments is coplanar and flush with one said exterior surface in which said recess is defined.

4. A tool case as recited in claim 2, wherein there are plural said compartments pivotable relative to their module, between open and closed positions.

5. A tool case as recited in claim 4, such that in said closed position, an outer face of each of said compartments is coplanar and flush with one said exterior surface in which said recess is defined.

6. A tool case as recited in claim 4, wherein said compartments are ganged together for ganged movement between said open and closed positions.

7. A tool case as recited in claim 6, wherein said compartments are ganged together by virtue of a gang bar connecting each of said compartments.

8. A tool case as recited in claim 7, such that in said closed position, an outer face of each of said compartments is coplanar and flush with one said exterior surface in which said recess is defined.

9. A tool case as recited in claim 6, such that in said closed position, an outer face of each of said compartments is coplanar and flush with one said exterior surface in which said recess is defined.

* * * * *